US008591485B2

(12) United States Patent
Lissner et al.

(10) Patent No.: US 8,591,485 B2
(45) Date of Patent: Nov. 26, 2013

(54) SYSTEM, METHOD, AND PUMP TO PREVENT PUMP CONTAMINATION DURING NEGATIVE PRESSURE WOUND THERAPY

(75) Inventors: Andreas Lissner, Gebesee (DE); Peter Assmann, Gebesse (DE)

(73) Assignee: Prospera Technologies, LLC, Fort Worth, TX (US)

( * ) Notice: Subject to any disclaimer, the term of this patent is extended or adjusted under 35 U.S.C. 154(b) by 345 days.

(21) Appl. No.: 12/766,751

(22) Filed: Apr. 23, 2010

(65) Prior Publication Data

US 2011/0038741 A1 Feb. 17, 2011

Related U.S. Application Data

(60) Provisional application No. 61/172,091, filed on Apr. 23, 2009.

(51) Int. Cl.

| | |
|---|---|
| ***A61M 1/00*** | (2006.01) |
| ***A61M 27/00*** | (2006.01) |
| ***F04B 53/00*** | (2006.01) |
| ***F04B 53/20*** | (2006.01) |
| ***F15D 1/00*** | (2006.01) |

(52) U.S. Cl.
USPC ..... 604/313

(58) Field of Classification Search
USPC ..... 604/313, 19, 290, 315; 417/313; 137/15.08
See application file for complete search history.

(56) References Cited

U.S. PATENT DOCUMENTS

| | | | | |
|---|---|---|---|---|
| 4,346,711 | A * | 8/1982 | Agdanowski et al. | 604/128 |
| 5,636,643 | A | 6/1997 | Argenta et al. | |
| 5,645,081 | A | 7/1997 | Argenta et al. | |
| 6,071,267 | A | 6/2000 | Zamierowski | |
| 6,142,982 | A | 11/2000 | Hunt et al. | |
| 6,648,862 | B2 * | 11/2003 | Watson | 604/319 |
| 6,800,074 | B2 | 10/2004 | Henley et al. | |
| 7,004,915 | B2 | 2/2006 | Boynton et al. | |
| 7,198,046 | B1 | 4/2007 | Argenta et al. | |
| 7,216,651 | B2 | 5/2007 | Argenta et al. | |
| 7,276,051 | B1 | 10/2007 | Henley et al. | |
| 7,279,612 | B1 | 10/2007 | Heaton et al. | |
| 7,338,482 | B2 | 3/2008 | Lockwood et al. | |
| 2005/0209574 | A1 | 9/2005 | Boehringer et al. | |
| 2006/0100586 | A1 | 5/2006 | Karpowicz et al. | |
| 2007/0021697 | A1 | 1/2007 | Ginther et al. | |
| 2007/0032755 | A1 * | 2/2007 | Walsh | 602/2 |
| 2007/0055209 | A1 * | 3/2007 | Patel et al. | 604/315 |
| 2007/0219512 | A1 | 9/2007 | Heaton et al. | |
| 2007/0219532 | A1 | 9/2007 | Karpowicz et al. | |
| 2009/0093778 | A1 | 4/2009 | Svedman | |
| 2009/0200800 | A1 * | 8/2009 | Chen | 285/353 |

FOREIGN PATENT DOCUMENTS

| | | | |
|---|---|---|---|
| DE | 202008002751 | U1 | 6/2008 |
| EP | 1674127 | A1 | 6/2008 |
| EP | 1674127 | B1 | 8/2008 |

* cited by examiner

*Primary Examiner* — Loan Thanh
*Assistant Examiner* — Andrew S Lo
(74) *Attorney, Agent, or Firm* — Bracewell & Giuliani LLP

(57) ABSTRACT

A pump assembly suitable for negative pressure wound therapy that includes an internal filter for preventing contamination in various components of the pump assembly, such as the pump unit. The internal filter is located in an isolated filter chamber, and inlet vacuum tubing that could contain fluids or bacteria are located inside a double containment sleeve to prevent contamination of components of the pump. The inlet vacuum tubing may be removed without opening the main pump housing and without contaminating the contents of the pump housing.

4 Claims, 10 Drawing Sheets

SYSTEM, METHOD, AND PUMP TO PREVENT PUMP CONTAMINATION DURING NEGATIVE PRESSURE WOUND THERAPY

CROSS-REFERENCE TO RELATED APPLICATIONS

This application claims priority to provisional application 61/172,091, filed Apr. 23, 2009 and incorporated herein by reference.

BACKGROUND OF THE INVENTION

1. Field of the Invention

This invention generally relates to the field of negative pressure wound therapy pumps. In particular, the present invention is directed to a method and apparatus for protecting a medical vacuum pump from contamination.

2. Brief Description of Related Art

Medical vacuum pumps are used in a variety of applications, including, for example, wound drainage and negative pressure wound therapy. Because the medical vacuum pumps often pull fluids from wounds, external collection canisters are used to collect the liquids before the liquids reach the pump itself. Similarly, filters can be placed between the collection canister and the pump to prevent liquids and bacteria from reaching the pump. The canister and filter, thus, reduce the opportunity for liquid fluids and bacteria to enter the pump and contaminate the pump.

If the internal components of a pump motor become contaminated with fluids or bacteria, the pump may not be used for any other patients for fear of cross-contamination and infection. The external filter and collection canister provide a degree of protection against contamination. Improper use of the pump, such as failing to use the external filter, however, can significantly increase the probability of pump contamination.

The tubing from the wound site to the collection canister and external filter may be the same diameter as the tubing from the canister or filter to the vacuum port inlet on the pump. Thus it is possible to connect the tubing from the wound site directly to the pump, thus bypassing the filter and canister. Similarly, the canister could be connected directly to the pump without the filter. A problem arises if the external filter is not installed during operation. The pump could ingest fluid when the filter is not installed, resulting in contamination of the pump.

Furthermore, in some applications, the user may choose not to use an external filter. Unfortunately, internal filters may be difficult to use because they require the entire pump housing to be opened to reach the filter. It is desirable to have an internal filter, that is easy to use, that can reliably protect a pump regardless of operator error.

SUMMARY OF THE INVENTION

In an exemplary embodiment of the present invention, a pump has an internal filter to be used in conjunction with an external filter. The internal filter is located inside a filter chamber. The filter chamber is isolated from the interior of the pump housing and thus the filter can be accessed without opening the pump housing. A vacuum port is located on the exterior of the pump housing for connecting the pump to tubing or directly to a collection canister. The vacuum port comprises a removable nipple located inside a bushing. An inlet tube forms a passage between the inlet nipple and the internal filter. An outer containment tube is attached to the bushing and to a bushing on the filter chamber. The inlet tube is located inside the outer containment tube, thus preventing contamination from the inlet tube from contacting other components of the pump.

Should the internal filter become contaminated, in an example embodiment, the pump will stop functioning until the filter is replaced. To replace the filter, in an example embodiment, a technician disconnects any external tubing, opens the filter chamber, cuts or disconnects tubing attached to the filter, removes the inlet nipple from the bushing, and pulls the inlet tube out through the bushing. The technician then attaches a new inlet tube to a new inlet nipple, feeds the inlet tube through the bushing and outer containment tube to the filter chamber, attaches the inlet tube to the inlet side of a new filter, attaches the filter outlet tube to the outlet of the new filter, secures the nipple in the bushing, and replaces the cover on the filter chamber.

BRIEF DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

Figure 1:
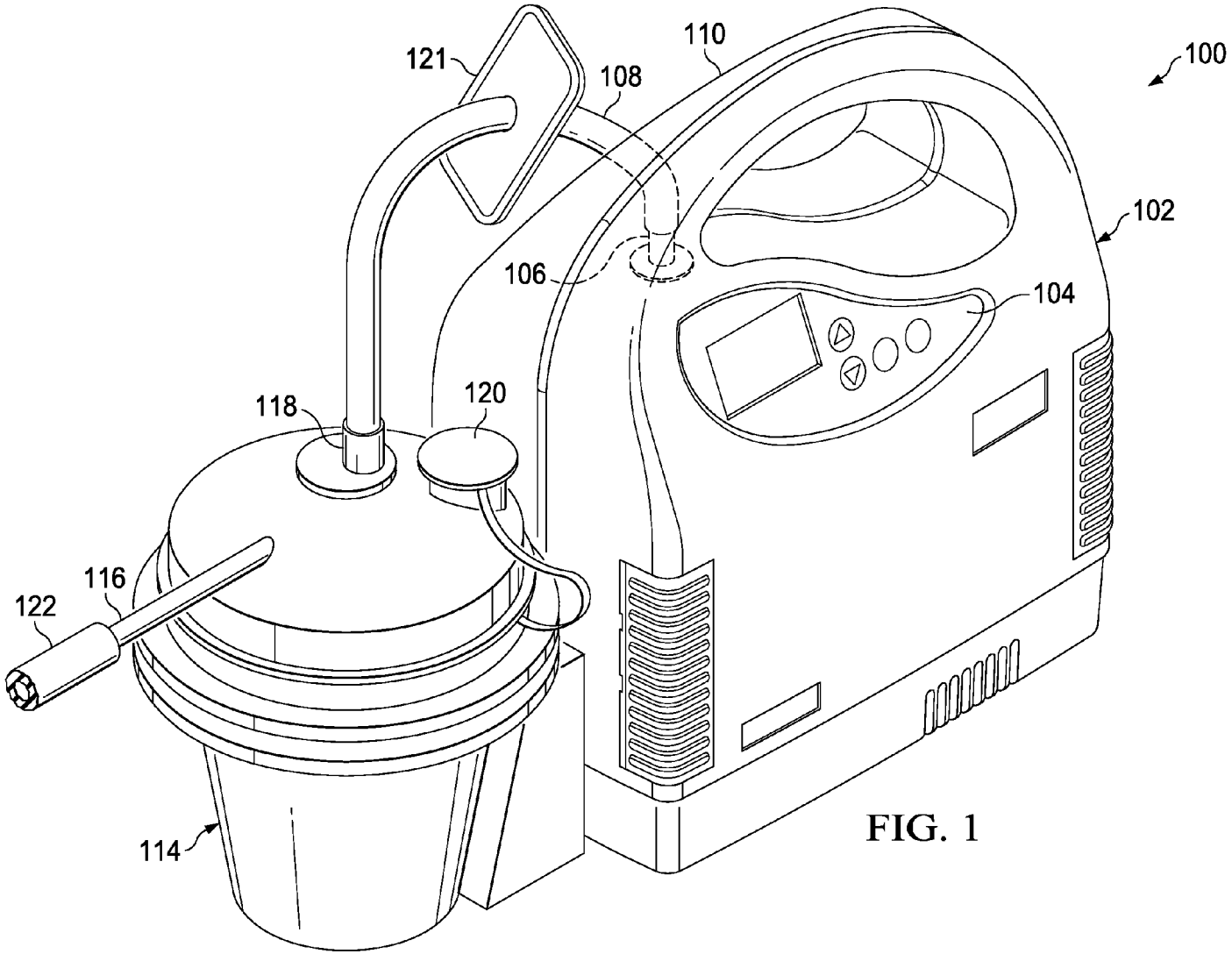
FIG. 1 is an orthogonal exterior view of the front of an exemplary embodiment of a dual-filter pump system.

Referring to FIG. 1, shown in a perspective view is an example embodiment of a vacuum pump assembly 100 that includes a pump housing 102. Pump housing 102 can be a rigid shell that houses the components of the vacuum pump assembly 100 and may be made of plastic, metal, or any other suitable material. In some embodiments, the pump housing 102 serves as a frame for supporting other components of the vacuum pump assembly 100, such as a vacuum pump motor, filter, electronic controls 104, etc. In other embodiments, a frame (not shown) is located within the housing 102 to support the various components. The pump housing 102 may have various openings such as air outlets, vents, and vacuum ports 106 for attaching tubes 108. In some embodiments, the exterior of the pump housing 102 may have a handle 110. The exterior of the pump housing 102 may have brackets 112 (FIG. 2) that could be used to affix the pump housing 102 to another device or frame, or to attach a device such as a collection canister 114 to the pump housing 102.

Still referring to FIG. 1, collection canister 114 may be in fluid communication with the vacuum port 106 via external connection tube 108. In some embodiments, collection canister 114 has a float valve (not shown) for stopping the flow of air when the fluid level reaches a predetermined point. Collection canister 114 may also have an inlet port 116, an outlet port 118, and an access point 120 with a cap.

In an example embodiment, external connection tube 108 is a pliable tubing that is sufficiently rigid such that it does not collapse on itself when subjected to vacuum pressures. One end of external connection tube 108 engages fitting 118 on collection canister 114 while the other end engages vacuum port 106. In some embodiments, collection canister 114 is attached directly to pump housing 102. In some embodiments (not shown), collection canister 114 may have a fitting that connects directly to vacuum port 106, thus not requiring an external tube between collection canister 114 and vacuum port 106.

In some embodiments, external filter 121 is located in-line on external connection tube 108. External filter 121 may comprise a housing and filter element (not shown). The filter element may include a hydrophobic bacterial material capable of preventing liquid or bacteria from passing through the external filter 121, yet still allowing gas, i.e. air, flow therethrough. In some embodiments, external filter 121 has different colors on each side of the housing such that, for example, external filter housing is clear on the side facing collection canister, and blue on the side facing vacuum pump assembly 100. In some embodiments, external filter 121 may be located inside canister 114. Filter 121 may block all flow after becoming saturated or absorbing a predetermined amount of liquid.

Figure 3:
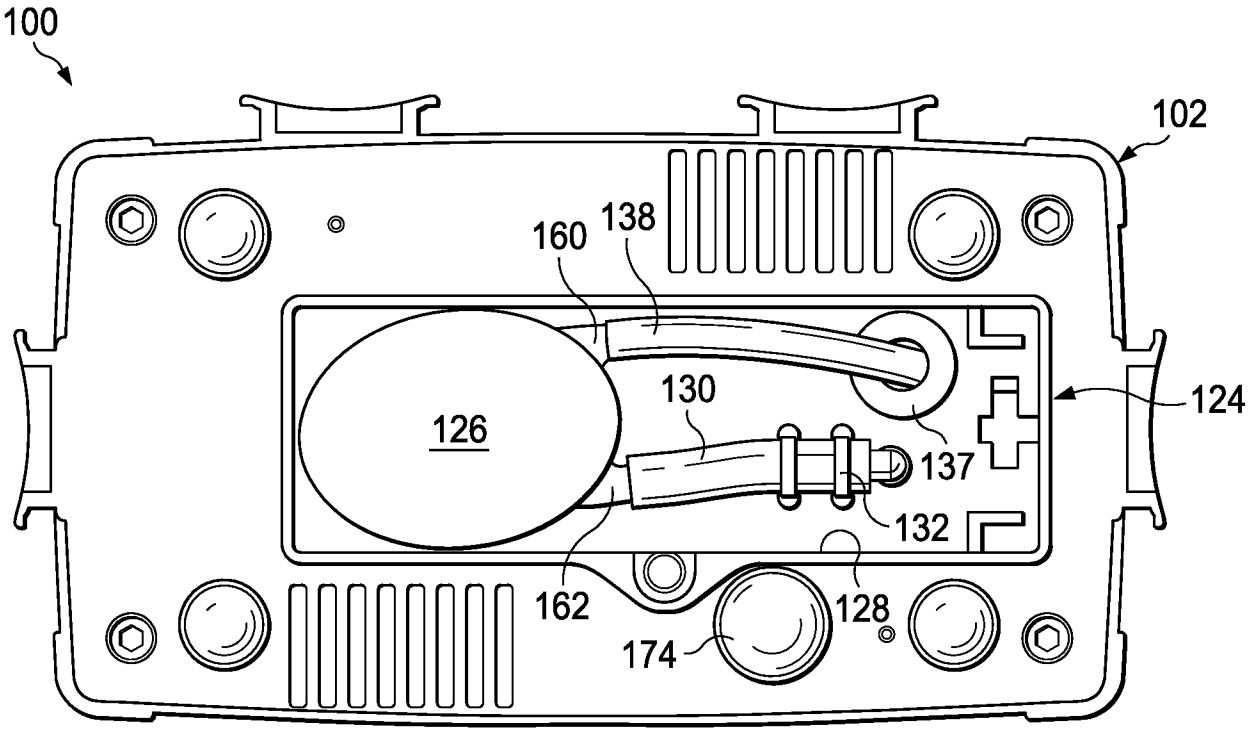
FIG. 3 is an exterior view of the bottom and a filter chamber of the dual-filter pump of FIG. 1.

An upward looking view of the pump assembly 100 is provided in FIG. 3; in this embodiment a filter chamber 124 is shown located within pump housing 102 and containing filter assembly 126. In an exemplary embodiment, the filter chamber 124 is a compartment within the housing 102 having rigid upper and side chamber walls 128 above and along the outer periphery of the filter chamber 124 thereby separating the contents of the filter chamber 124 from the other components of the pump assembly 100.

As will be described in more detail below, the components inside filter chamber 124, such as filter assembly 126, may be replaced without opening pump housing 102 to expose other components located inside pump housing 102 (such as pump motor and electronics). In some embodiments, the filter chamber 124 is hermetically sealed. In other embodiments, the chamber 124 generally isolates the contents of the chamber from the interior of the pump housing 102, but may have openings between the chamber 124 and the pump housing 102. The openings could be, for example, used to secure tubing 130 shown connected between an outlet connection 162 of the filter assembly 126 outlet to a passage formed through the upper chamber wall 128. Tubing 130 may be secured to the inside of the chamber 124 slide fasteners 132 shown inserted through holes in the upper chamber wall 128 and around tubing 130. The filter chamber 124 may be integral to the pump housing 102, or it may be a separate chamber (not shown) attached to the pump housing 102. The filter assembly 126 of FIG. 3 also includes an inlet connection 160 that provides fluid communication between the filter assembly 126 and an inlet tube 138.

Figure 4:
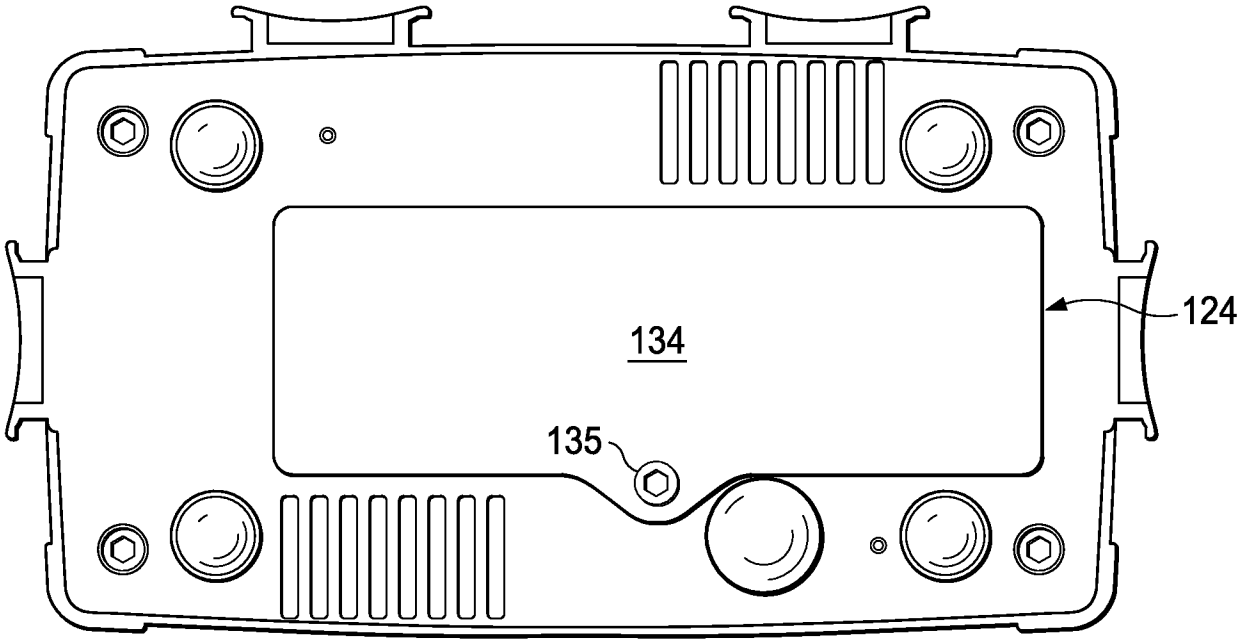
FIG. 4 is an exterior view of the bottom of the dual-filter pump of FIG. 1, showing a filter chamber cover in place.

Referring to FIG. 4, filter chamber 124 may be covered by a door or a cover 134, thus enclosing the chamber 124. The door or cover 134 may be opened to allow access to the internal filter assembly 126 (FIG. 3) and the inside of the filter chamber 124. In some embodiments, the door or cover 134 detaches from the pump housing 102 or chamber 124 upon opening. In other embodiments, the door or cover 134 remains attached to the housing 102 or chamber 124, such as by hinges or by slidingly engaging the housing 102, when the door or cover 134 is moved to the open position. In some embodiments, filter chamber 124 is not considered "user accessible" and thus filter replacement requires an authorized technician to open filter chamber cover 134. Access to internal filter unit 126 can be limited by, for example, using a locking device 135 to secure cover 134. Locking device can be, for example, a screw that requires a tool to open. In one embodiment, the tool to open could be a hex-key or other tool that an unauthorized user is not likely to have. In an alternative embodiment, locking device 135 is a lock that requires a key to open. In these embodiments, a person authorized to open cover 134 such as, for example, a pump service technician, will have the key or tool required to open. Unauthorized users, thus, are prevented from opening cover 134.

Figure 5:
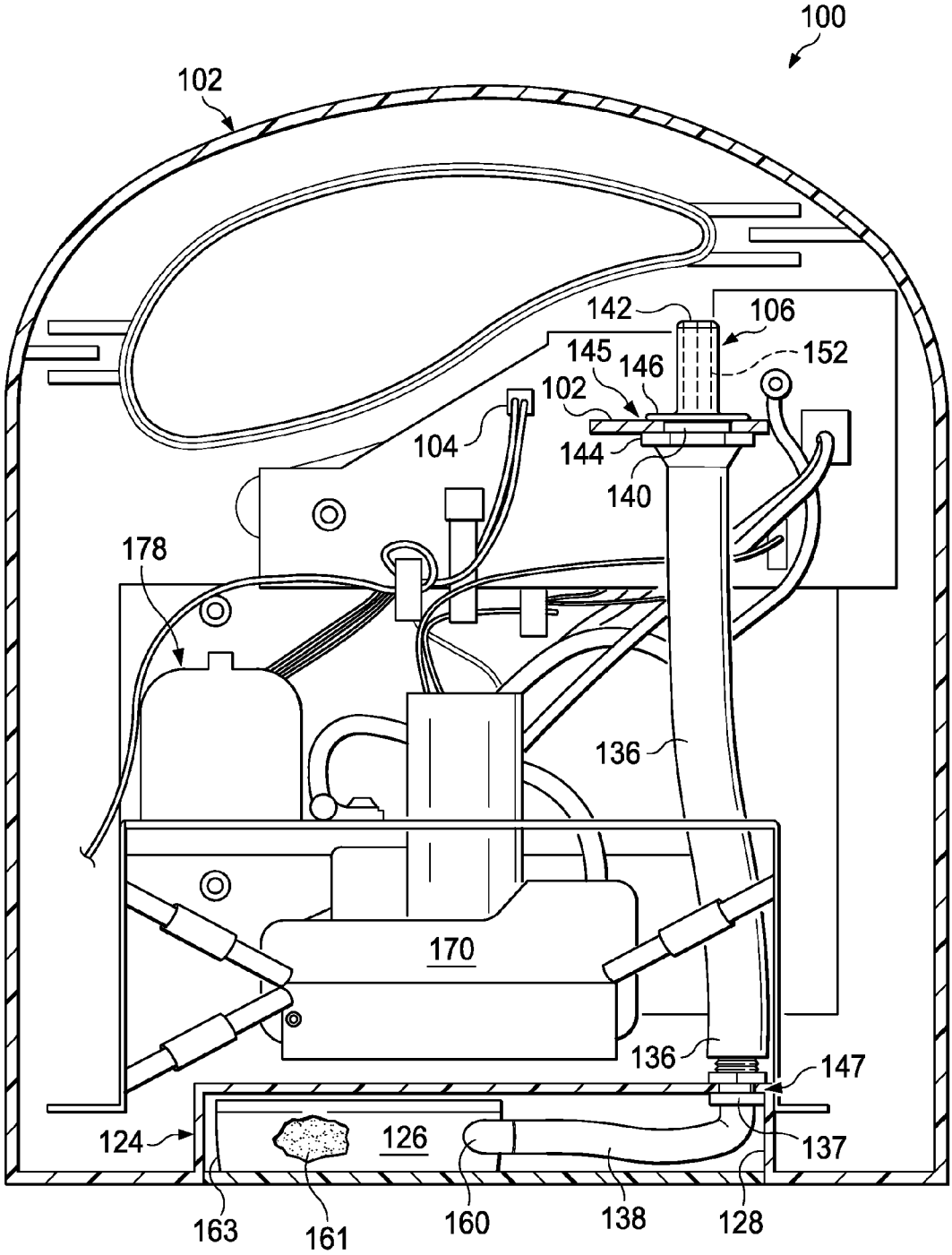
FIG. 5 is a partial sectional rearward view of the dual-filter pump of FIG. 1.

Referring to FIG. 5, an example embodiment of the pump assembly 100 is shown in a side partial sectional view revealing certain components within the pump housing 102. In this view an outer sleeve 136 is a generally cylindrical tube that forms a passage between an opening 145 in the pump housing 102, through the interior of the pump housing 102, to an opening 147 in the upper wall of the filter chamber 124. The ends of the outer sleeve 136 are shown attached to bushings 140, 137 respectively provided in openings 145, 147. The outer sleeve 136 may be generally straight or may have longitudinal curves to facilitate the efficient placement of components inside the pump housing 102. Outer sleeve 136 may be made of a rigid material, such as hard plastic or metal, or a pliable material such as tubing. In an example embodiment, the outer sleeve 136 has sufficient thickness to retain fluids therein and the outer sleeve 136 couplings at the ends of the outer sleeve 136 form hermetic seals. Thus, any liquids or bacteria that are released inside the outer sleeve 136 will generally remain inside outer sleeve 136 or drip into filter chamber 124 without contaminating any components within the pump housing 102.

Some embodiments may not use an outer sleeve 136. In these embodiments (not shown), filter inlet tube 138 passes directly into filter chamber 124 without passing through any other part of the interior of pump housing 102.

The vacuum port 106 of FIG. 5 is a fitting on the exterior of the pump housing 102 that can be used for attaching external connection tube 108 to the pump assembly 100. In addition to the bushing 140, the vacuum port 106 includes a vacuum port nipple 142 shown above and coaxial to the bushing 140. The bushing 140 can be secured to the housing 102 by a nut 144 illustrated located inside housing 102 and a flange 146, shown located outside housing 102. In an exemplary embodiment, outer sleeve 136 slides over bushing 140. Optionally, the inner diameter of outer sleeve 136 may be smaller than the outer diameter of bushing 140, resulting in a force fit. A hose clamp (not shown) may be used to secure outer sleeve 136 to bushing 140. The inner diameter of bushing 140, at the opposite end of bushing 140 from where outer sleeve attaches, may have slots or threads for receiving locking tabs 150 (FIG. 6A) or threads of nipple 142.

Figure 6B:
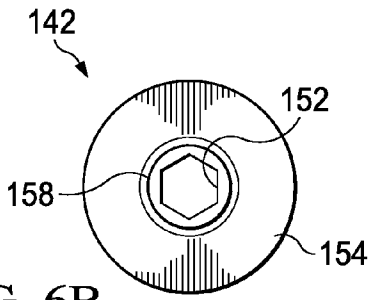
FIGS. 6A and 6B are respectively side and perspective views is a view of a vacuum port nipple of the dual-filter pump of FIG. 1.
Figure 6A:
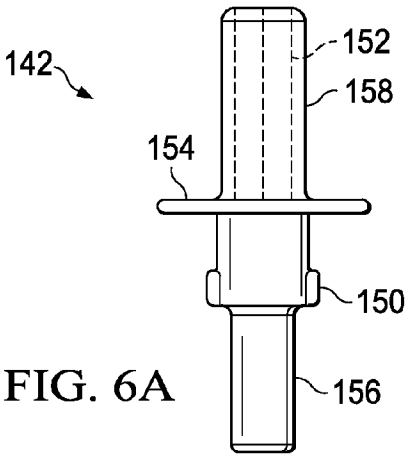

Referring to FIGS. 6A and B, respectively shown in a side view in phantom lines and in a plan view, is an example embodiment of the vacuum port nipple 142 having a passage 152 formed axially therethrough. As shown in FIGS. 6A and 6B, the passage 152 outer periphery defines a hexagonal pattern with flat surfaces for receiving a tool such as an Allen wrench (also known as a hex-key). In an exemplary embodiment, when the external connection tube 108 (FIG. 1) is not attached, vacuum port nipple 142 may be rotated with Allen wrench thus removing nipple 142 from bushing 140. Nipple 142, thus, has an attached position wherein it engages and is concentrically located in bushing 140, and a detached position when it is disengaged from bushing 140.

In an example embodiment, vacuum port nipple 142 attaches to bushing 140 (FIG. 5) via quarter-turn tabs 150 or threads (not shown) located on the outside of vacuum port nipple 142. Vacuum port nipple 142 may have a flange 154 wherein the outer diameter of flange 154 can be roughly the same as the outer diameter of flange 146 of bushing 140. Vacuum port nipple 142 can have a smooth outer diameter ("OD") surface 156 for engaging the inner diameter ("ID") of internal inlet tube 138. The connection between inlet tube 138 and nipple 142, thus, is a frangible connection. Other means of attaching vacuum port nipple 142 to bushing 140 may be used. Vacuum port nipple 142 may also have a smooth outer diameter surface 158 that protrudes outward from housing 102 for engaging vacuum tube 108. In one embodiment, an operator can manually engage and disengage vacuum tube 108 from vacuum port nipple 142. Vacuum port nipple 142 may be configured to be rotated by any of a variety of tools or by hand. In some embodiments, vacuum port nipple 142 may comprise an orifice (not shown) wherein vacuum tube 108 or a fitting on collection canister 114 is inserted into the orifice. Thus the inner diameter of vacuum port nipple 142 will engage the outer diameter of vacuum tube 108 or collection canister fitting (not shown).

Figure 8:
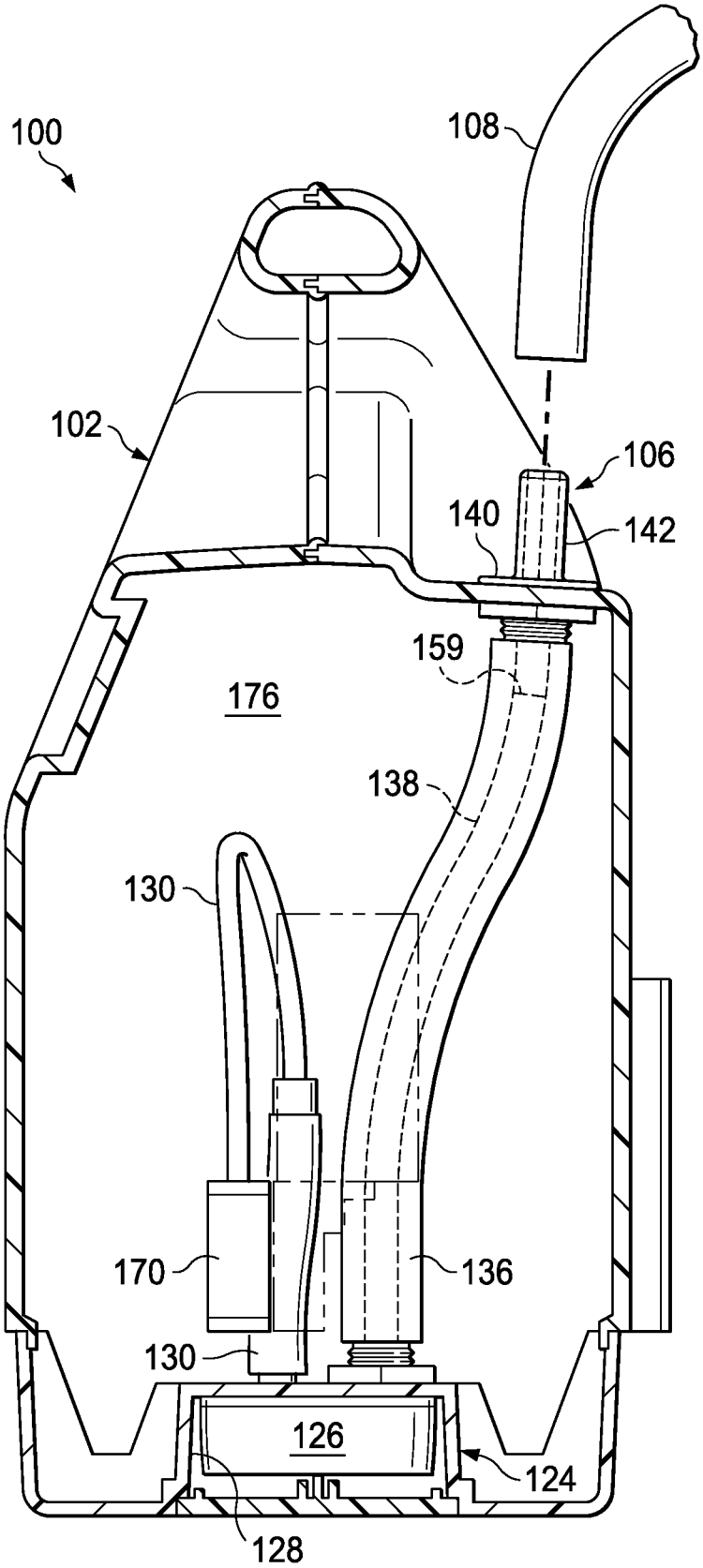
FIG. 8 is a partial sectional side view of the dual-filter pump of FIG. 1.

Referring now to FIG. 8, a side partial sectional view of an embodiment of the pumping assembly 100 is illustrated depicting the internal inlet tube 138 in phantom passing from vacuum port nipple 142, through outer sleeve 136, to filter assembly 126. Internal inlet tube 138 is a tubing that is generally pliable such that it can bend within outer sleeve 136, but is sufficiently rigid that the walls of internal inlet tube 138 will not collapse when suction is applied to the tube. Inlet tube 138 is contained inside outer sleeve 136. If inlet tube 138 leaks any fluid, the fluid will be contained in outer sleeve 136. Furthermore, inlet tube 138 is not exposed to the internal components of pump assembly 100 and thus inlet tube 138 can be removed without contacting any internal components of pump assembly 100. Internal inlet tube 138 can have cutting point 159, which is a point along inlet tube 138 located axially below outer diameter surface 156 of nipple 142. Cutting point 159 is a point wherein inlet tube 138 may be severed to allow removal of a portion of inlet tube 138 and filter assembly 126, as a module. Cutting point 159, thus, can be considered a frangible connection along inlet tube 138.

Referring now to FIG. 5, in an example embodiment, the filter assembly 126 is made up of a filter element 161 located inside a housing 163. In an example, the filter element 161 includes hydrophobic bacterial material. As indicated above, filter assembly 126 has in inlet connection 160 and an outlet connection 162, where the inlet tube 138 can forcibly slide over inlet connection 160, forming a seal. The connection can be such that an operator can manually engage and disengage inlet tube 138 from inlet connection 160. Similarly, an operator can manually engage and disengage outlet tube 130 from outlet connection 162. The engagement between inlet tube 138 and inlet connection 160, thus, is a frangible connection. Likewise, the engagement between outlet connection 162 and internal pump tube 130 is a frangible connection. In an example embodiment, gas or vapor is flowable through the filter element 161, but fluid and bacteria is trapped within. In the event filter element 126 becomes saturated with liquid and/or bacteria, or absorbs a predetermined amount of liquid, all flow, i.e. gas, liquid, and bacteria, is blocked.

Figure 7:
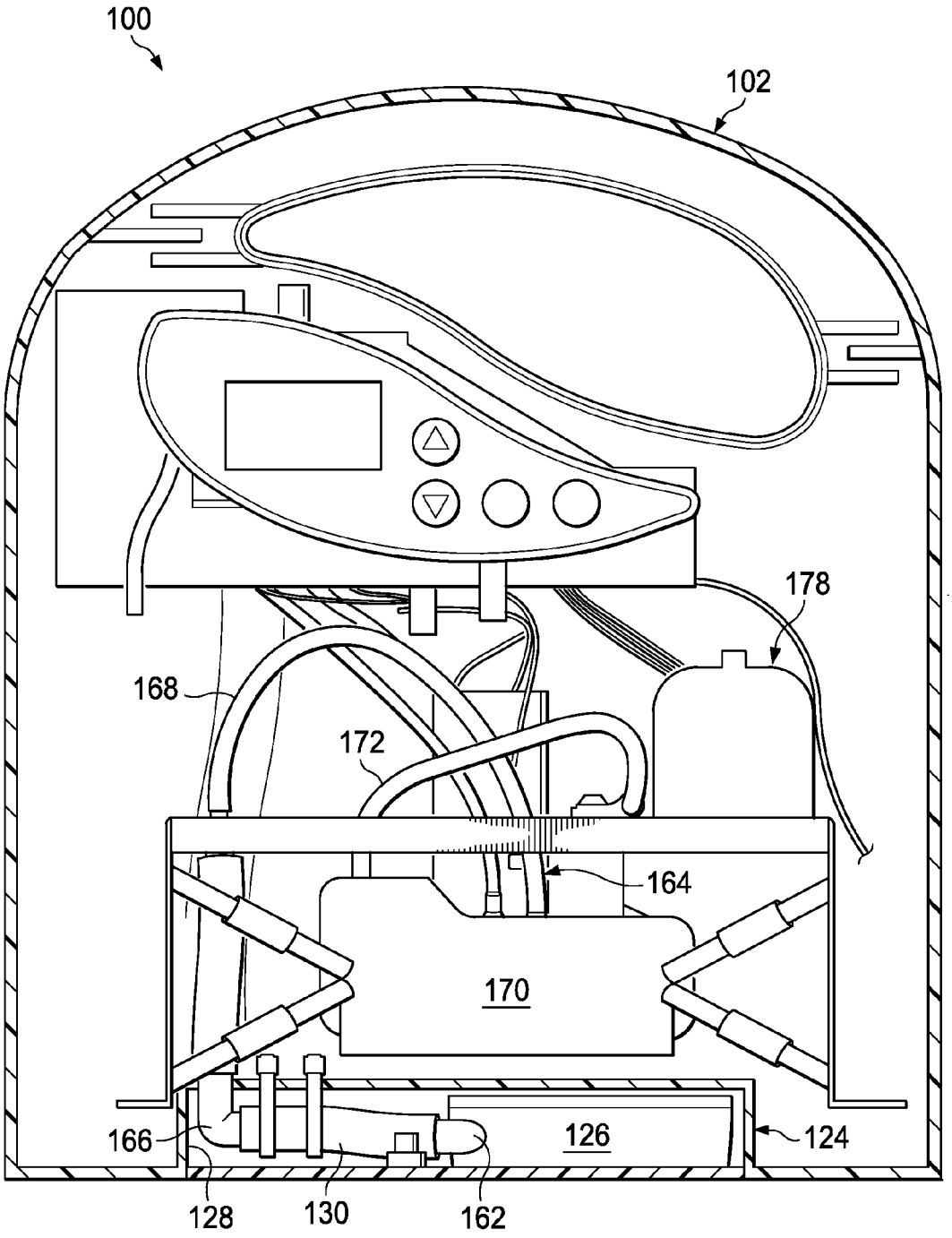
FIG. 7 is a partial sectional frontal view of the dual-filter pump of FIG. 1.

Referring to FIG. 7, a side partial sectional view of an example pump assembly 100 depicts the internal pump tube 130 attached to outlet connection 162 on filter assembly 126. Internal pump tube 130 may be made of a generally pliable tubing, wherein the tubing is sufficiently rigid that it will not collapse when vacuum is applied. Internal pump tube 130 forms a pathway from filter outlet connection 162 to a pump inlet 164. In some embodiments, a single tube (not shown) connects outlet connection 162 to pump inlet 164. In other embodiments, internal pump tube 130 may attach to a fitting such as right-angle fitting 166. In this embodiment, a second tube 168 may connect from the right-angle fitting 166 to pump inlet 164.

The pump inlet 164 distal the outlet connection 162 is illustrated coupled to a vacuum 170. In the embodiment of FIG. 7, the vacuum pump 170 can be a conventional medical grade vacuum pump capable of generating suction. In an exemplary embodiment, vacuum pump 170 may generate vacuum pressure up to 200 mmHg and have an air flow rate of 5-20 liters per minute. Fluid received by the vacuum pump 170 through the pump inlet 164 is pressurized and delivered to a pump outlet 172. In an exemplary embodiment, pump outlet 172 exhausts through an exhaust port 174 (FIG. 3) shown formed through the pump housing 102 below the vacuum pump 170. Pump outlet 172 may exhaust elsewhere such as, for example, into the interior of pump housing 102, provided that pump housing 102 has an exhaust vent.

From time to time it may be desired or necessary to replace the filter assembly 126; which can be accessed via the filter chamber cover 134 (FIG. 4). Referring back to FIG. 8, a cavity 176 inside pump housing 102, that defines a space where the vacuum pump 170 and components are located, can remained sealed when the filter assembly 126 is replaced or otherwise serviced. Thus the components of pump assembly 100 located within cavity 176 are not disturbed during replacement/service of the filter assembly 126. Furthermore, during filter replacement, the risk of contaminant exposure is limited to the interior of filter chamber 124 and the interior of sleeve 136. Components such as the pump 170, electronic controls 104 (FIG. 1) and batteries 178 (FIG. 5) are not exposed to fluids and contaminants, regardless of whether fluids entered the vacuum port 106 and reached filter assembly 126.

For the purposes of discussion herein, negative pressure wound therapy ("NPWT") can describe applying negative pressure to a wound site. In an example, vacuum pump assembly 100 (FIG. 1) is used to create negative pressure for NPWT where values of the negative pressure may be constant or variable. In some embodiments, value of negative pressure range from, for example, about −20 mm/Hg to about −80 mm/Hg.

Figure 9:
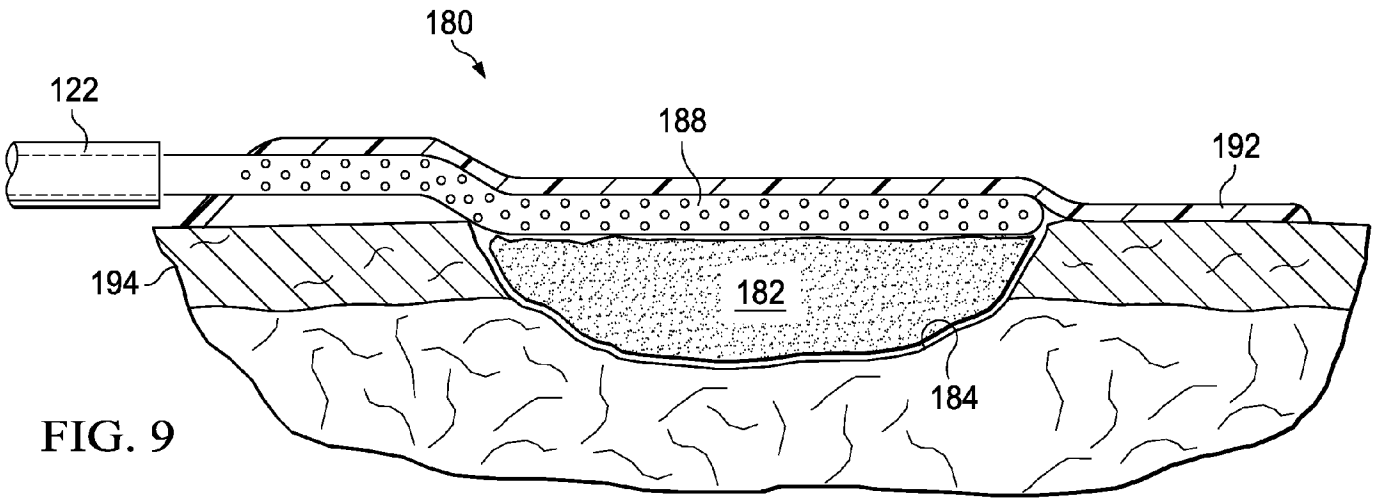
FIG. 9 is a sectional view of an exemplary embodiment of a negative pressure wound therapy wound dressing in place on wound bed for the application of suction by the dual-filter pump of FIG. 1.

Referring to FIG. 9, in an exemplary embodiment, a NPWT dressing 180 is shown in a side sectional view and including a dressing medium 182, such as fluffed gauze or foam, which is placed on a wound bed 184. A drain 188, such as Prospera® Round Channel or perforated Flat Drain can be placed above dressing medium 182. Other types of dressings and drains may be used. Dressing tubing 122 is attached from the end of drain 188 to vacuum canister inlet 116 (FIG. 1). A semi-permeable wound dressing cover 192, such as Tegaderm®, Opsite®, or Bioclusive®, is placed over the dressing to form a seal over the wound cavity. The semi-permeable wound dressing cover 192 adheres or is attached to healthy skin 194 surrounding wound bed 184. Other types of dressing covers may be used.

In an example of operation, vacuum pump assembly 100 is used to generate suction for a NPWT dressing 180 by creating a pressure differential between the wound bed 184 and drain 188 that draws fluids and bacteria from the wound, through Dressing tubing 122, through fitting 116, and into canister 114. Under normal operating conditions, canister 114 is emptied before it is completely full and thus fluid and bacteria does not enter external filter 121 or internal filter assembly 126. Should fluids enter external filter 121, external filter 121 will become partially blocked or completely blocked, causing pump 170 to shut off.

Figure 2:
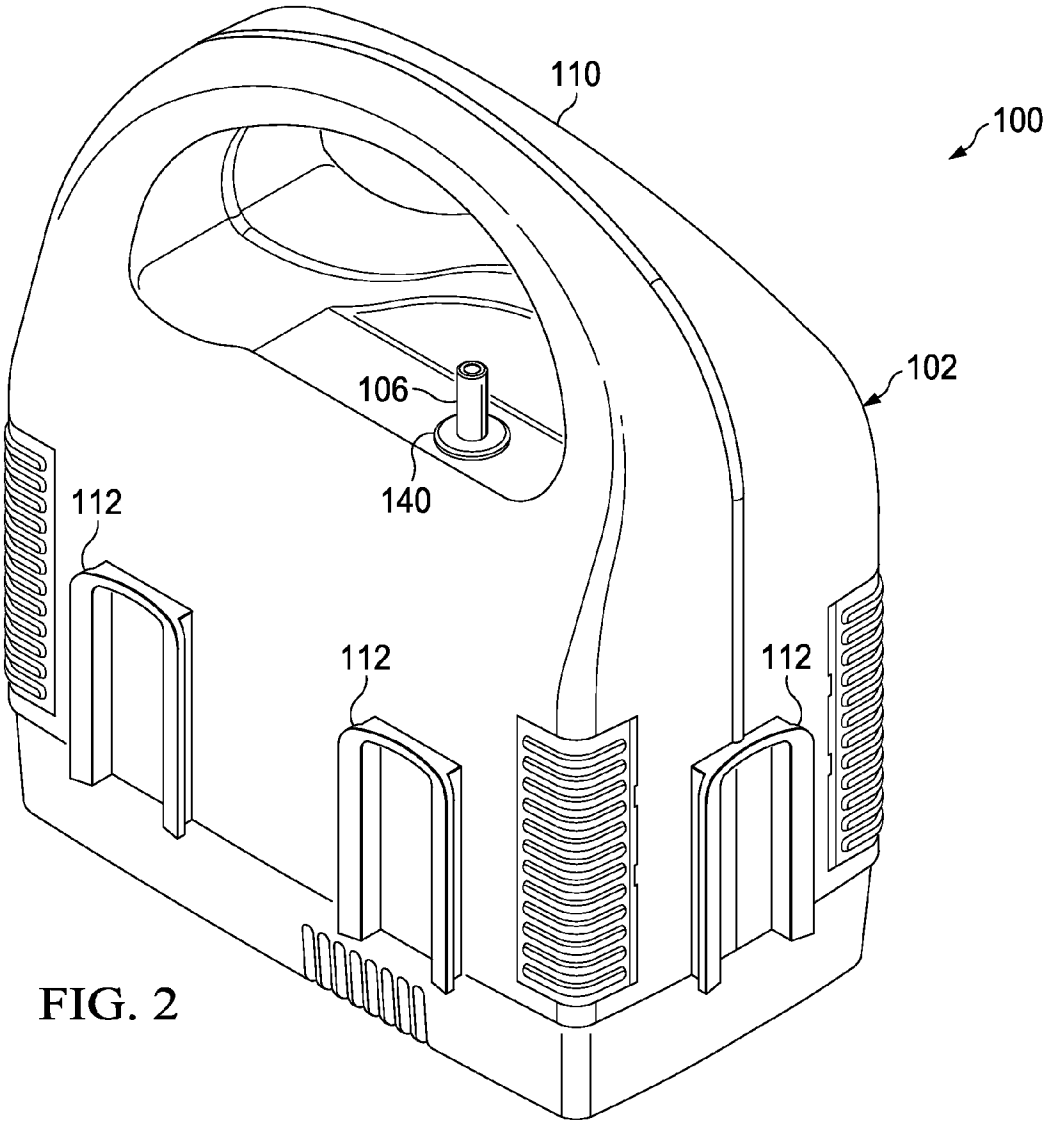
FIG. 2 is a rear orthogonal view of the dual-filter pump system of FIG. 1.

Under some operating conditions, liquid from a wound may be able to enter pump assembly 100. This could occur if components are missing or damaged. For example, the collection container 114 or external filter 121 could be damaged or a health-care provider could inadvertently bypass collection container 114 and filter 121, resulting in vacuum line 122 being connected directly to external fitting 106 (FIG. 2). If liquid from a wound or bacteria passes through vacuum port nipple 142, the liquid and/or bacteria will travel through filter inlet tube 138, through filter inlet 160, and become trapped inside internal filter assembly 126. Like external filter 121, internal filter assembly 126 will become partially or completely blocked when it is saturated with liquid.

Pump 170 and/or vacuum lines associated with pump 170 may be equipped with sensors (not shown) for detecting flow or pressure during operation. In the event either filter 121, 126 (FIG. 5) becomes blocked due to saturation, or flow to pump 170 is stopped for any other reason, a sensor will cause the pump to alarm, stop, or both alarm and stop. In an exemplary embodiment, electronic controls deactivate pump 170 when sensors measure a change in pressure or flow characteristics. In an exemplary embodiment, pump 170 will stop before any liquid and/or bacteria bypasses internal filter.

Figure 10A:
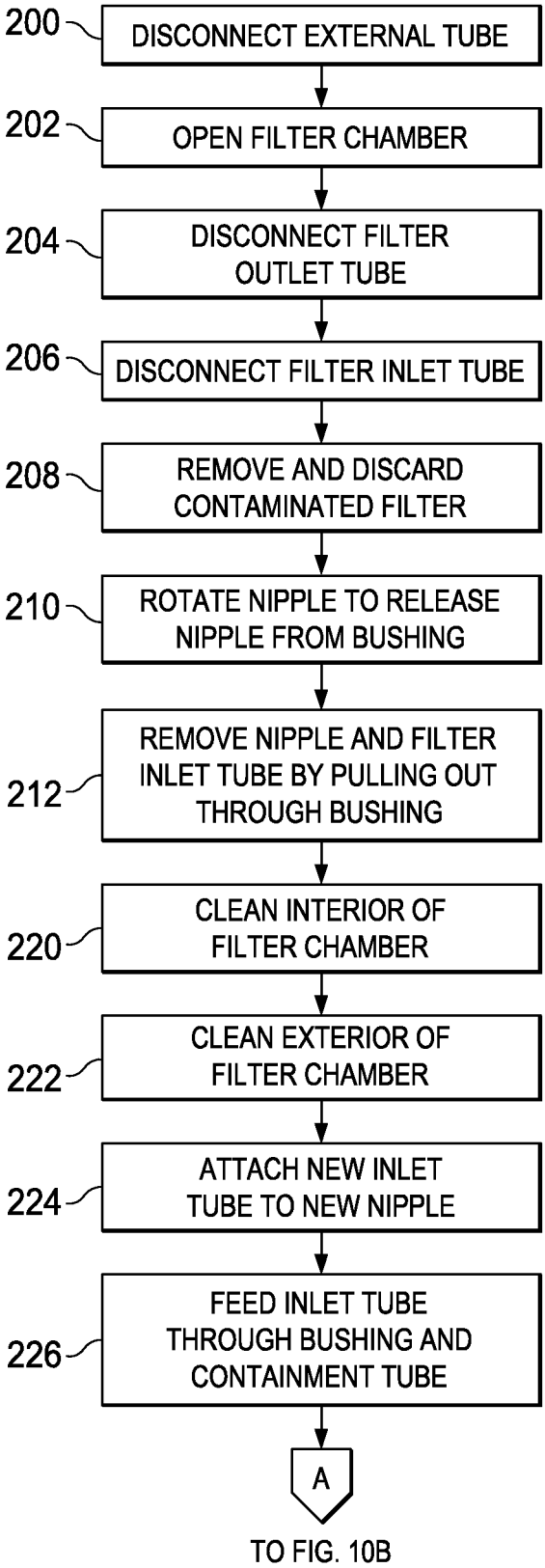
FIGS. 10A-10B are schematic depictions of a flow chart showing an example embodiment of a filter replacement sequence for contaminated components of the dual filter pump of FIG. 1.
Figure 10B:
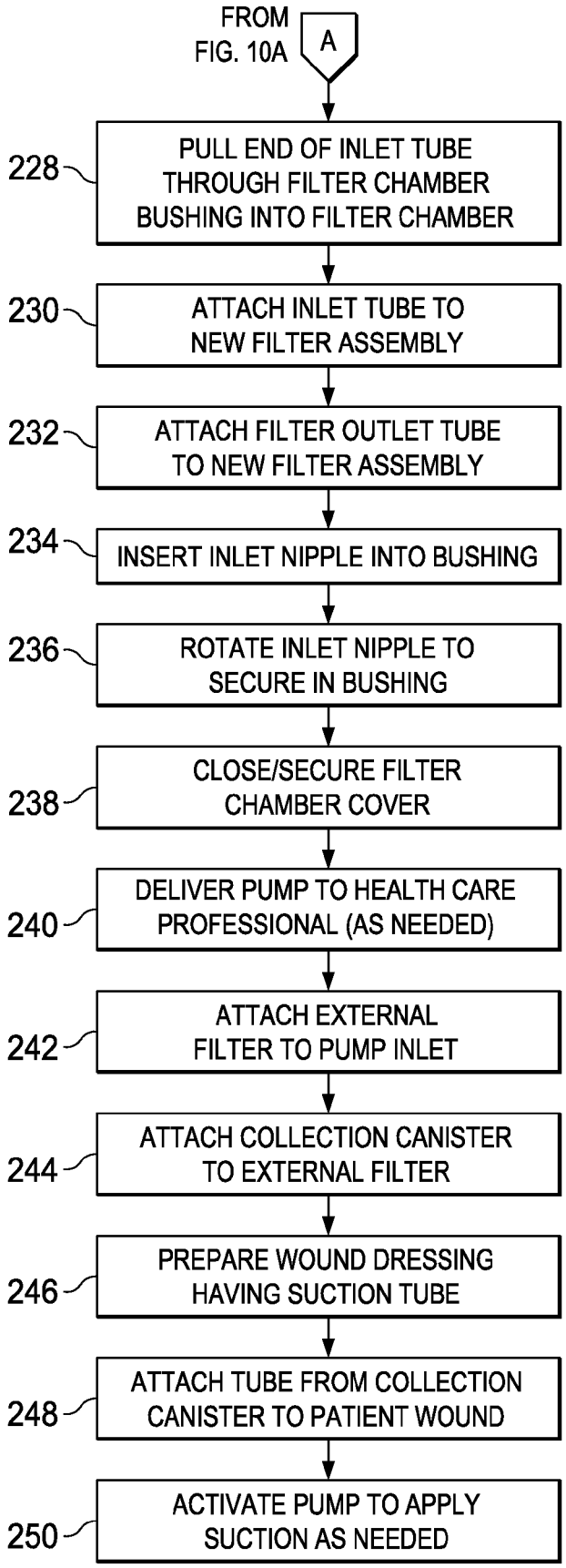

A flowchart is provided in FIGS. 10A-10B illustrating an example embodiment of a process of operation of the vacuum pump assembly 100. In the event the internal filter assembly 126 becomes contaminated or simply needs routine replacement, a health-care professional or technician can disconnect the external tube 108 from the inlet 106, as shown in step 200. In some embodiments, filters may be replaced after a predetermined amount of time such as, for example, 1000 hours of pump use. The filter chamber cover 134 can be opened, such as by a technician, to expose the filter assembly 126 (step 202). The filter outlet tube 130 can be disconnected from filter outlet 160 or from the right-angle connection 166 in step 204. In an exemplary embodiment, the filter outlet tube 130 remains uncontaminated because the filter assembly 126 prevents contamination from entering the filter outlet tube 130. Shown in step 206, the filter inlet tube 138 can be disconnected by detaching the filter inlet tube 138 from the filter inlet 162 or by cutting the filter inlet tube 138. A plug, cap, or clamp (not shown) can be installed on the end or ends of the filter inlet tube 138 to contain any contamination inside the tube. When both tubes 130, 138 are removed or severed, filter assembly 126 may be removed from filter chamber 124 (step 208).

An Allen wrench may be used to turn nipple 142 to release it from bushing 140 in step 210. Once nipple 142 is released from bushing 140, nipple 142 and filter inlet tube 138 may be pulled out of pump assembly 100, as indicated by step 212. Sleeve 136 remains in place. At this point, filter chamber 124 and the interior of outer sleeve 136 is accessible and may be cleaned by conventional means, such as disinfectant wipes or swabs in step 220.

To install a new filter, a new filter inlet tube 138 can be attached to a new nipple 142 (step 224) and then the new filter inlet tube 138 can be slid through outer sleeve 136 and into contact with the filter chamber 228 (step 226). In some embodiments, inlet tube 138 and nipple 142 are pre-assembled. As indicated by step 228, the filter inlet tube 138 may be pulled from the filter chamber 124 until the end is at the desired position and nipple 142 contacts bushing 140. The end of filter inlet tube 138 can then be attached to a new filter assembly 126 (step 230) and the filter outlet tube 130 attached to new filter assembly 126, and new filter assembly 126 can be placed inside filter chamber 124 (step 232). Nipple 142 can be secured inside bushing 140 as shown in steps 234 and 236. The filter chamber cover 134 can be closed and secured in place in step 238. In some applications, filter cover 134 may be locked to prevent unauthorized access. Pump assembly 100 is now in condition for continued use or use with a different patient. If pump assembly 100 was returned to a service center for filter replacement or was returned to supplier and supplier wishes to send to another user, the pump assembly 100 may be sent to user, such as health-care professional, in step 240. The health-care professional can then attach, via tubing, an external filter 121 in step 242, and then attach, via tubing, a collection canister in step 244. The health-care professional may prepare a wound for drainage or suction in step 246, and then attach Dressing tubing 122 from canister 114 to the prepared wound in step 248. Finally, the health-care professional can activate the pump assembly 100 to apply suction to create negative pressure, as indicated by step 250.

In some embodiments, a health care professional may attach external connection tube 108, external filter 121, and collection canister 114 to pump assembly 100. The health care professional can create a NPWT wound dressing 180 and attach Dressing tubing 122 to canister 114. Filter 121 may be located in a variety of places, such as within canister 114 or directly attached to pump vacuum port 106. In some embodiments, filter 121 is not used.

Health care professional can then activate pump assembly 100 to create negative pressure at the wound site. The suction created by pump 170 is drawn through tube 168, through filter outlet tube 130, through filter assembly 126, through filter inlet tube 136, through external connection tube 108, through external filter 121, through canister 114, through Dressing tubing 122, to the NPWT dressing 180. Air and gas drawn through the pathway and into pump 170 is discharged by, for example, passing through pump discharge tube 172 (FIG. 7), which may lead to exhaust port 174 (FIG. 3). In some embodiments, pump assembly 100 has variable pressure and cycles between various predetermined pressures.

While the invention has been shown or described in only some of its forms, it should be apparent to those skilled in the art that it is not so limited, but is susceptible to various changes without departing from the scope of the invention.

Furthermore, recitation of the term about and approximately with respect to a range of values should be interpreted to include both the upper and lower end of the recited range. As used herein, the terms first, second, third and the like should be interpreted to uniquely identify elements and do not imply or restrict to any particular sequencing of elements or steps.

Although the present invention has been described in detail, it should be understood that various changes, substitutions, and alterations can be made hereupon without departing from the principle and scope of the invention. Accordingly, the scope of the present invention should be determined by the following claims and their appropriate legal equivalents.

The singular forms "a", "an" and "the" include plural referents, unless the context clearly dictates otherwise.

Optional or optionally indicates that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

In the drawings and specification, there have been disclosed a typical preferred embodiment of the invention, and although specific terms are employed, the terms are used in a descriptive sense only and not for purposes of limitation. The invention has been described in considerable detail with specific reference to these various illustrated embodiments. It will be apparent, however, that various modifications and changes can be made within the spirit and scope of the invention as described in the foregoing specification and as defined in the appended claims.

That claimed is:

1. A medical vacuum pump system, the system comprising:

a pump housing having an interior cavity;

a filter chamber located inside the pump housing, the filter chamber being substantially isolated from the interior cavity;

an access panel on an exterior of the pump housing, the access panel providing access to the filter chamber;

an internal filter located inside the filter chamber, the internal filter having an inlet and an outlet, preventing at least a portion of bacteria entering the inlet from passing to the outlet and halting flow through the internal filter when the internal filter absorbs a predetermined amount of moisture;

a bushing located in an orifice of the pump housing, the bushing having a first end and a second end;

an outer sleeve connected to the first end of the bushing and in communication with the filter chamber;

an internal inlet tube located inside an outer containment tube, the internal inlet tube having a first end and a second end;

a vacuum port releasably engaged in the second end of the bushing and protruding from a surface of the pump housing;

a vacuum pump motor, wherein the vacuum pump motor is in communication with the internal filter;

electronic controls associated with the pump motor and with a pressure sensor in communication with the pump motor, wherein the electronic controls stop the pump motor when the pressure sensor determines there is no flow through the internal filter;

wherein the first end of the internal inlet tube is connected to the internal filter and the second end of the internal inlet tube is connected to the vacuum port; and wherein the outer sleeve isolates the internal inlet tube from the interior cavity.

2. The system according to claim 1, further comprising:

an external filter having an external filter inlet and an external filter outlet, in communication with the internal inlet tube, and preventing at least a portion of bacteria entering the external filter inlet from passing to the external filter outlet; and a collection canister having a collection canister inlet and a collection canister outlet, in communication with the external filter, for containing at least a portion of a fluid that enters the collection canister.

3. The system according to claim 2, further comprising a dressing medium adapted to be positioned in a wound bed, a drain tube above the dressing medium, and a semi-permeable wound dressing covering the dressing medium and adapted to sealingly engage skin around the wound bed, wherein the drain tube is in communication with the collection canister.

4. The system according to claim 2, wherein the internal inlet tube and the internal filter can be removed without contaminating the interior cavity of the pump housing.

* * * * *